United States Patent [19]

Miller, deceased et al.

[11] 4,279,532

[45] Jul. 21, 1981

[54] ROADWAY NOSING UNIT

[75] Inventors: Henry Miller, deceased, late of London, England; Desmond Byrne, legal representative, Huntingdon, England

[73] Assignee: Acme Flooring Limited, Huntingdon, England

[21] Appl. No.: 53,516

[22] Filed: Jun. 29, 1979

[51] Int. Cl.[3] ..... E01C 11/02

[52] U.S. Cl. ..... 404/68; 52/396; 238/8

[58] Field of Search ..... 404/68, 69, 47, 48, 404/46; 52/396; 238/8

[56] References Cited

U.S. PATENT DOCUMENTS

| | | | |
|---|---|---|---|
| Re. 20,378 | 5/1937 | Hall | 404/69 |
| 398,062 | 2/1889 | MacLeod | 404/46 X |
| 1,275,321 | 8/1918 | Suter | 238/8 |
| 1,580,035 | 4/1926 | Gusmer | 238/8 |
| 1,935,823 | 11/1933 | Turner | 404/46 |
| 2,089,025 | 8/1937 | Hedgcock | 238/8 |
| 2,256,025 | 9/1941 | Hoak | 238/8 |
| 3,192,577 | 7/1965 | Barr | 404/47 X |
| 3,387,544 | 6/1968 | MacLellan | 404/68 X |
| 3,465,963 | 9/1969 | Caillet | 238/8 |
| 3,713,368 | 1/1973 | McDowell | 404/69 |
| 3,779,660 | 12/1973 | McGeary | 404/69 |
| 3,880,539 | 4/1975 | Brown | 404/68 X |
| 4,007,994 | 2/1977 | Brown | 404/69 |
| 4,203,547 | 5/1980 | van der Harst | 238/8 |

*Primary Examiner*—Nile C. Byers, Jr.

*Attorney, Agent, or Firm*—Berman, Aisenberg & Platt

[57] ABSTRACT

A nosing unit for supporting a flexible member in an expansion gap of a roadway, which nosing unit comprises a laminated wood base to be fixed in a rebate formed in the edge of a roadway section adjacent to the expansion gap, and a topping part detachably secured to the base and serving in use of the nosing unit to present part of a road surface adjacent a said expansion gap.

14 Claims, 2 Drawing Figures

ROADWAY NOSING UNIT

Figure 1:
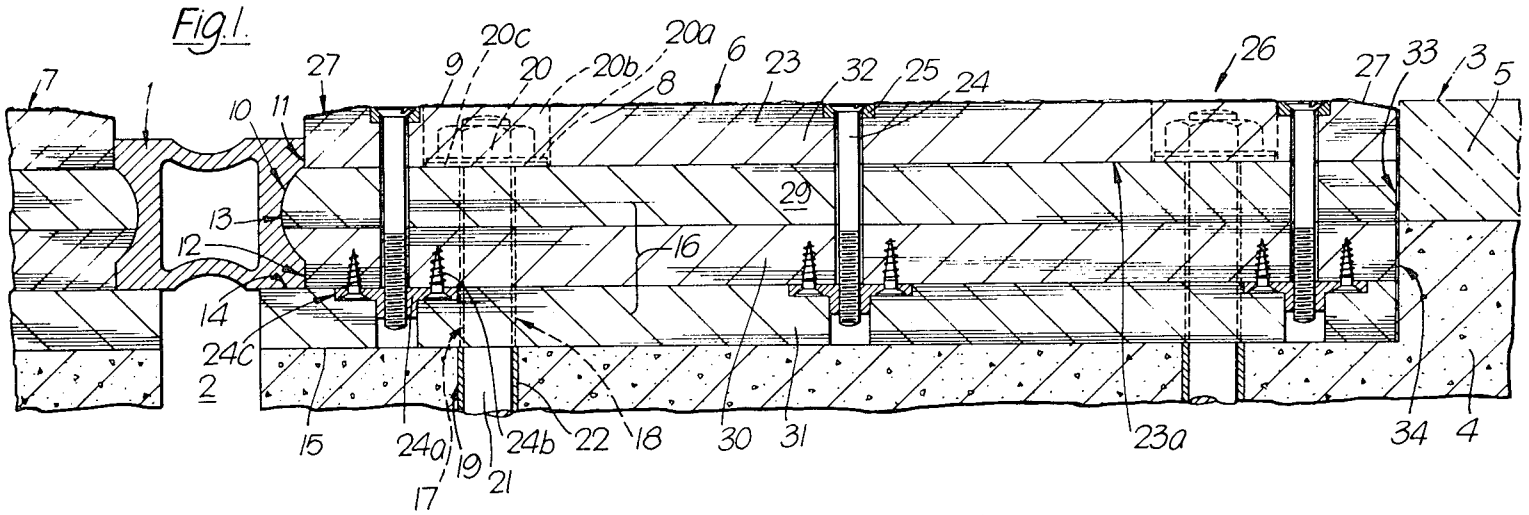

This invention relates to improvements in or relating to expansion joints for roadways and especially for bridges. The invention finds particular application in the case of roadways for vehicles but is also applicable to pedestrian roadways.

A known expansion joint for a bridge roadway comprises an elongate flexible member, in the form of a hollow extrusion of natural or synthetic rubber, which is supported in an expansion gap between two sections of the roadway by two mounting arrangements, hereinafter called nosing units. Each nosing unit is fixed to a respective one of the two roadway sections in a rebate formed in the edge of the section adjacent to the expansion gap, the nosing units forming part of the roadway at each side of the gap. Each nosing unit mates with a respective profiled longitudinal bearing surface of the flexible member to retain the flexible member in the expansion gap and to transmit expansion movement of the road sections to the flexible member which deforms resiliently to adapt itself to variations in the width of the expansion gap. The flexible member acts as a weather seal between the two sections of roadway.

In known expansion joints the nosing units are made of steel or epoxy resin cast in situ. These known nosing units are however very rigid and transmit shocks to the roadway sections, thereby tending to break down the material of the roadway and to loosen the fixing between the nosing unit and the roadway section particularly in the case of a roadway constructed from concrete. If the nosing units are made of epoxy resin they tend to be brittle and have a short life because of the wear to which they are subjected from vehicle road wheels. The replacement of a worn nosing unit is time consuming and causes delay to traffic using the roadway.

It is an aim of the present invention to improve the construction of expansion joints for roadways by providing a nosing unit which avoids the disadvantages mentioned above.

With this aim in view, the invention is directed to a nosing unit for supporting a flexible member in an expansion gap of a roadway, which nosing unit comprises a laminated wood base to be fixed in a rebate formed in the edge of a roadway section adjacent to the expansion gap, and a topping part detachably secured to the base and serving in use of the nosing unit to present part of a road surface adjacent the expansion gap.

The problem of shock being transmitted to a roadway section to loosen the fixing between the nosing unit and roadway section is considerably reduced because the laminated wood base of a nosing unit according to the invention is far more shock absorbent than previously known epoxy resin or steel nosing units. Further, the laminated wood base is durable and hard wearing in contrast to a brittle epoxy resin nosing unit.

A particular advantage of a nosing unit according to the invention is that in the event of the topping part which presents part of the road surface becoming worn, the worn topping part can be removed in a very short time and replaced by a new topping part. Thus, the delay to traffic using a roadway will be only minimal when it is necessary to change a worn topping part.

As in the case of known nosing units, a nosing unit according to the invention preferably has an engagement surface shaped to mate directly with a profiled bearing surface of a flexible member to be supported.

Preferably, the base comprises a plurality of laminated wood sheets bonded together.

Conveniently, the laminated wood is plywood, e.g. W.B.P. birch plywood (i.e. weather-proof and boil-proof plywood).

Desirably, the topping part is detachably secured to the base part by means of screws or bolts.

Advantageously, the base part has a plurality of captive nuts secured to it, and bolts co-operate with the captive nuts to secure the topping part to the base. The topping part, like the base, can be made of W.B.P. birch plywood.

In one embodiment of the invention the wooden base may have a ledge which forms a seat for the flexible member.

The invention also provides an expansion joint comprising an elongate flexible member supported in an expansion gap between two sections of a roadway by two nosing units according to the invention, each nosing unit being fixed to a respective one of the two roadway sections.

Figure 2:
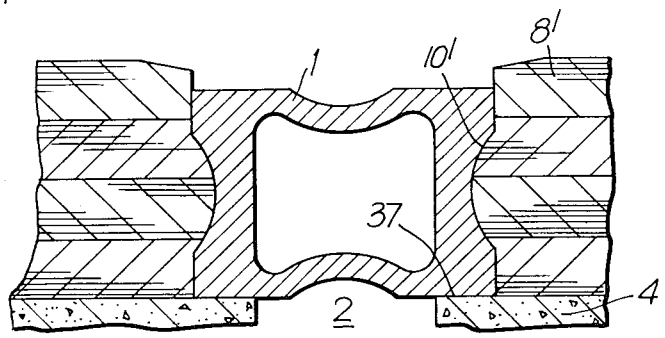

Preferred embodiments of the invention will now be described, by way of example, with reference to the accompanying drawing, in which:

FIG. 1 is a longitudinal vertical cross-section through a bridge roadway provided with an expansion joint embodying the invention; and FIG. 2 illustrates a deeper expansion joint 1' supported on concrete 37.

Referring to FIG. 1, an expansion joint for a bridge roadway comprises an elongate flexible member 1 in the form of a hollow extrusion of natural or synthetic rubber such as that supplied by Macellan Rubber Ltd., under the designation Macspansion Type Sl. To provide continuity of the roadway the member 1 is supported in an expansion gap 2 extending transversely of the roadway between two roadway sections, only one section 3 being shown in FIG. 1. The roadway section 3 comprises a concrete substrate 4 and a surface layer 5 of e.g., asphaltic blacktop or concrete.

The flexible member 1 is supported in the gap 2 by two nosing units 6 and 7, each nosing unit being fixed in a rebate formed in the edge of the associated roadway section adjacent to the expansion gap 2. Only the nosing unit 6 is shown in detail and will be described hereinafter, the unit 7 being of identical construction.

The nosing unit 6 comprises a substantially rectangular wooden structure 8 having an upper surface 9 which is substantially coplanar with the surface of the roadway section. The wooden structure 8 has an engagement surface 10 shaped to mate with a longitudinal bearing surface of the member 1, the engagement surface 10 having two plane surface portions 11 and 12 engaging corresponding plane surface portions of the bearing surface of the member 1 and, between the surface portions 11 and 12 a part-cylindrical protruding surface portion 13 engaging in a corresponding part-cylindrical recess in the bearing surface of the member 1. The wooden structure of the nosing unit 6 is formed at a lower edge of the engagement surface with a ledge 14 which is spaced from a lower surface 15 of the wooden structure and forms a seat for the flexible member 1. The flexible member 1 is thus retained in the expansion gap and expansion movement of the roadway section is transmitted to the member 1 which deforms resiliently to adapt itself to variations in the width of the expansion gap 2.

The wooden structure 8 comprises a base part 16 to which is detachably secured a topping part 23 forming a nosing unit. The base part 16 consists of three superimposed W.B.P. birch plywood sheets 29, 30 and 31 bonded together and the topping part 23 consists of a single such sheet 32. The nosing unit is laid on a bed of bitumen (hot) containing a proportion of ground rubber, on a sound prepared surface on concrete substrate 4 underlying the structure 8 and the base part 16 is fixed to the concrete substrate 4 by fixing bolts 17 which extend through bores 18 in the base part 16 into bores 19 in the concrete substrate. Said bed of bitumen is too thin to be shown in the drawing. Each bolt 17 has a nut 20 and washer 20*a* received in a clearance hole 20*b* in the topping part 23 and a shank 21 which is anchored in the bore 19 by epoxy resin mortar 22. A hard rubber washer 20*c* may be inserted under washer 20*a* to maintain pressure on nut 20 should there be any change in vertical thickness of base part 16. The spacing of bores 18 and clearance hole 20*b* may be positioned to suit site template if existing structure reinforcement rod location require variation in bore centres.

The topping part 23 is detachably secured on the base part 16 by countersunk machine screws 24 with the interposition between the topping part and base part of a seal composed of bitumen (laid hot) containing a proportion of ground rubber. This seal is too thin to be shown in the drawing, and is positioned at 23*a*. The screws 24 have their heads received in brass cups 25 countersunk into the upper surface of topping part 23.

The machine screws 24 are held in nuts 24*a* which are held captive by woodscrews 24*b* on the underside of plywood sheet 30. Base plywood sheet 31 is counterbored at 24*c* on its upper surface to form stepped bores each of which receives one of the nuts 24*a* and the lower end of one of the machine screws 24. The nuts 24*a* are secured in position prior to the bonding together of plywood sheets 29, 30 and 31. The upper surface 26 of the topping part 23 constitutes an anti-skid road surface and joins the engagement surface 10 at two bevel edges 27, one of which leads down to the flexible member 1 and the other of which leads to road section 3.

The structure 8 presents a vertical abutment surface 33 which abuts a concrete vertical surface 34 of the rebate in the road section 3 with the interposition of a bitumen (hot) seal the seal being too thin to be shown in the drawing and, containing a proportion of ground rubber. This bitumen seal is applied after structure 8 has been secured in position.

It will be appreciated that the rebate in the roadway section to accommodate the nosing unit can be formed by removing concrete from an existing roadway or by appropriately shuttering a roadway under construction.

In fixing a bolt 17 a plastics sac containing resin and hardener for forming epoxy resin mortar is placed in the bore 19, the bolt is gripped in the chuck of a drill, and the shank of the bolt is inserted into the bore and rotated. The rotation of the bolt 17 causes the sac to burst and then mixes the resin and hardener.

Rotation of the bolt is then stopped whereupon the mortar rapidly sets and anchors the bolt in the concrete. In FIG. 2, the construction of the nosing unit is the same as in the FIG. 1 embodiment, except that the engagement surface 10' extends from near the upper to the lower surface of the wooden structure 8'. The nosing unit is placed further back from the gap 2 to expose the rebated concrete substrate 4 which forms a seat 37 for the deeper flexible member 1'. The substrate concrete 4 will have to be rebated further back at 34 at the right hand end to accommodate the nosing unit in position as shown in FIG. 2, which position is shifted to the right hand side as compared with the arrangement of FIG. 1.

The nosing unit shown in FIG. 1 is designed so that the topping part 23 is screwed to the base part 16 at the factory where the nosing unit is assembled. The clearance holes 20*b* are drilled through the topping part 23 to provide access for a tool for tightening the nuts 20. The holes to be sealed with bitumen after installation of the nosing unit.

The anti-skid surface of the topping part may be any suitable rugose surface, or may comprise a coating of a layer of cured hard synthetic resin as defined for example in our British Pat. No. 976,126 applied directly to the surface 26, stones of hard material being embedded in the resin, said stones preferably being of calcined bauxite, or granite or stone chippings as mentioned for example in that Patent.

In the embodiments illustrated, the right hand edge of the nosing unit is vertical. However, the nosing unit could instead be stepped from a bottom surface to the top surface so that in the installed position of the nosing unit the abutment surface of the nosing unit and the vertical face of the rebate define between them a gap for receiving a sealing material and having a width which increases towards the upper surface of the wooden structure. The steps of the abutment surface may be provided with projections, such as pins, for embedding in the sealing material.

We claim:

1. A nosing unit for supporting a flexible seal member in an expansion gap of a roadway, which nosing unit comprises a laminated wood base to be fixed in a rebate formed in the edge of a roadway section adjacent to the expansion gap, and a topping part detachably secured to the base and serving in use of the nosing unit to present part of a road surface adjacent the expansion gap.

2. A nosing unit as claimed in claim 1, in which the laminated wood of said base is plywood.

3. A nosing unit as claimed in claim 2, in which the plywood is W.B.P. birch plywood.

4. A nosing unit as claimed in claim 1, in which the base part has a plurality of captive nuts secured to it, and bolts serve to co-operate with the captive nuts to secure the topping part to the base.

5. A nosing unit as claimed in claim 1, in which the topping part is made of laminated wood.

6. A nosing unit as claimed in claim 5, in which the topping part is made of plywood, e.g., W.B.P. birch plywood.

7. A nosing unit as claimed in claim 1, in which the nosing unit has a profiled engagement surface shaped to mate with a profiled bearing surface of a said flexible seal member.

8. A nosing unit as claimed in claim 7, and having a bevelled edge interconnecting the engagement surface with an upper surface of the topping part.

9. A nosing unit as claimed in claim 1, in which the wooden base is provided with a ledge which forms a seat for a said flexible seal member.

10. An expansion joint comprising a pair of nosing units as claimed in claim 1, each said nosing unit being secured in a rebate in an edge of a respective one of two spaced-apart facing roadway sections whereby to define an expansion gap between said roadway sections, an elongate flexible sealing member being disposed between and supported by said nosing units.

11. An expansion joint as claimed in claim 10, in which screw threaded members are secured in bores made in the roadway material underlying the nosing units, these screw-threaded members projecting upwardly through bores in the bases of the nosing units, nuts being tightened onto the screwthreaded members to secure the bases to the underlying roadway material.

12. An expansion joint as claimed in claim 11, in which the nuts on the screwthreaded members lie in clearance holes in the topping parts.

13. An expansion joint as claimed in claim 10, in which the nosing units each have a vertical face abutting a vertical face of a rebate in a roadway section.

14. An expansion joint as claimed in claim 10, in which the nosing units each have a stepped face lying adjacent a vertical face of a rebate in a roadway section.

* * * * *